US006694552B1

(12) United States Patent
Vickers

(10) Patent No.: US 6,694,552 B1
(45) **Date of Patent: *Feb. 24, 2004**

(54) CONVERTIBLE DIAPER BAG/CHANGING PAD

(76) Inventor: Delores A. Vickers, 17805 Cheyenne Dr., Independence, MO (US) 64056

( * ) Notice: Subject to any disclaimer, the term of this patent is extended or adjusted under 35 U.S.C. 154(b) by 0 days.

This patent is subject to a terminal disclaimer.

(21) Appl. No.: 09/933,283

(22) Filed: Aug. 20, 2001

Related U.S. Application Data

(63) Continuation of application No. 08/971,100, filed on Nov. 14, 1997.

(51) Int. Cl.[7] ..... A47C 9/00
(52) U.S. Cl. ..... 5/655; 5/947
(58) Field of Search ..... 5/655, 417, 418, 5/419, 420, 482

(56) References Cited

U.S. PATENT DOCUMENTS

| | | | | |
|---|---|---|---|---|
| 2,203,538 A | | 6/1940 | Meilink | |
| 3,489,194 A | | 1/1970 | Hoover | |
| 4,154,323 A | | 5/1979 | Sneider | |
| 4,489,815 A | | 12/1984 | Martinez et al. | |
| 4,671,393 A | * | 6/1987 | Rainey | 5/417 |
| 4,886,150 A | | 12/1989 | Fritzsimmons | |
| 5,370,460 A | * | 12/1994 | Nelson | 5/417 |
| D358,717 S | | 5/1995 | Foreman | |
| 5,692,257 A | | 12/1997 | Albertieri | |
| D394,181 S | * | 5/1998 | Mitchell | D6/603 |
| 5,785,219 A | * | 7/1998 | Kraft | 5/419 |
| 6,298,509 B1 | * | 10/2001 | Vickers | 5/655 |

FOREIGN PATENT DOCUMENTS

EP 0023417 A1 * 2/1981 ..... A45C/9/00

* cited by examiner

*Primary Examiner*—Teri Pham Luu
*Assistant Examiner*—Fredrick Conley
(74) *Attorney, Agent, or Firm*—Shook, Hardy & Bacon LLP

(57) ABSTRACT

A device that is convertible to and from a blanket or diaper changing pad and carrying bag has a panel having a central portion and first and second side portions. Each side portion has pockets for storing desired articles, and a slot for receiving the strap of a changing table when the blanket or pad is used on the changing table. From an unfolded position, the blanket or pad conveniently folds to a carrying bag. Uniquely positioned handles are presented at the top of the bag when the blanket/pad is in its folded position.

11 Claims, 2 Drawing Sheets

CONVERTIBLE DIAPER BAG/CHANGING PAD

This is a continuation of application Ser. No. 08/971,100 filed Nov. 14, 1997.

BACKGROUND OF THE INVENTION

1. Field of the Invention

The present invention is directed to a changing blanket or pad upon which the diaper of a baby or child may be changed. More particularly, the present invention is directed to a diaper changing pad which converts, by folding, into a carrying bag.

2. Description of the Related Art

A variety of different types of blankets, changing pads, and diaper bags are currently available. Conventionally, diapers, wipes, and related products are carried in a diaper bag, and a separate blanket or changing pad is utilized as a surface when changing the diaper of an infant or child.

While conventional blankets, diaper changing pads, and diaper bags are widely used, they have numerous drawbacks. Most notably, when a conventional blanket or diaper changing pad is utilized, the parent or other person changing the child's diaper typically must reach into a separate bag for the diapers, wipes, lotions, or other products required for changing the child's diaper. This requires the individual changing the diaper to leave the child momentarily unattended. Moreover, searching in a diaper bag for the necessary products to change a diaper is inconvenient.

The need exists for a diaper changing pad, or blanket, which conveniently stores products, such as wipes, lotions, and diapers, necessary for changing a child's diaper. Additionally, the need exists for such a product that conveniently adapts to changing stations, including those used domestically and those typically found in public restrooms. Furthermore, the need exists for a blanket or diaper changing pad which conveniently folds into a carrying bag.

The present invention overcomes the drawbacks of the prior art, and fills the foregoing and other needs.

SUMMARY OF THE INVENTION

It is an object of the invention to provide a changing pad which conveniently folds into a carrying bag.

It is an object of the present invention to provide a blanket, or diaper changing pad, having pockets for storing items.

It is an additional object of the present invention to provide a diaper changing pad which conveniently operates with conventional domestic, and public changing stations having a safety strap for holding the child to be changed securely on the changing table of the station.

These and other objects are achieved by a blanket, or diaper changing pad, formed from a flexible, rectangular panel of material. The panel of material has a top side and a bottom side. The panel of the changing pad, or blanket, has a central diaper changing portion and first and second side portions respectively located at opposite sides of the central changing portion. Each of the side portions has a plurality of different sized pockets provided on the top side of the panel. The pockets are adapted, and sized, to receive various items, such as diapers, wipes, lotions or creams, a change of clothes, and toys. Preferably, the panel is formed from first and second outer pieces of material, separated by a third layer of material which serves as a pad or stiffener.

In accordance with the invention, the blanket includes at least one elastic loop sewn into the blanket. The loop may be utilized to releasably secure toys, such as conventional plastic rings or chains, to the pad. As will be appreciated, the rings, or chain, is useful to keep a child occupied while his or her diaper is being changed. Preferably, each elastic loop is small in size and is permanently secured deep within one of the pockets on the blanket or pad. Additionally, one or more straps, each of which has an outer free end, are releasbly secured to the blanket. As with the elastic loops, the straps are preferably fastened to the blanket or pad within one of the pockets. The outer free end of each strap is adapted to receive and hold a toy, or pacifier.

The diaper changing pad, or blanket, of the present invention also includes a pair of handles. When the pad is in an unfolded position, a first handle of the pair is positioned so as to extend outwardly from one side of the blanket or pad. The second handle is positioned on the bottom side of the blanket at a location approximately one-third the distance from the edge of the blanket opposite that edge from which the first handle extends.

In accordance with an aspect of the invention, the blanket or changing pad may be folded to form a convenient carrying bag. Particularly, the outer pocket-bearing side portions of the changing pad are folded inwardly over the top side of the panel of material. Thusly folded, the panel is then folded in thirds in a direction transverse to the direction the side portions were folded. In so doing, that handle which is located on the bottom side of the panel is positioned at one side of the carrying bag, in folded formation, at the top of the carrying bag. The first handle extends upwardly from the top of the folded carrying bag from an opposite side thereof. A fastener, such as a flap with button, snap, or hook and loop fastener is provided for holding the folded blanket or pad, in carrying bag formation, in its folded position.

In accordance with an additional aspect of the invention, each side portion of the blanket or changing pad has a slot extending inwardly from an outer edge thereof. When the present invention is utilized in combination with a conventional changing station having a table with safety straps, the central surface of the changing pad rests on the changing table, and each side portion hangs downwardly over opposite sides of the changing table. The safety strap on the table is then received within the respective slots so that the pocket bearing side portions hang conveniently downwardly, without the bunching that would be caused by the changing strap in the absence of the slots.

Accordingly, the present invention provides a blanket or changing pad which conveniently stores a variety of items, which easily unfolds for use and folds into a convenient carrying bag, and which is particularly adapted for use in combination with a conventional changing table having a safety strap.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
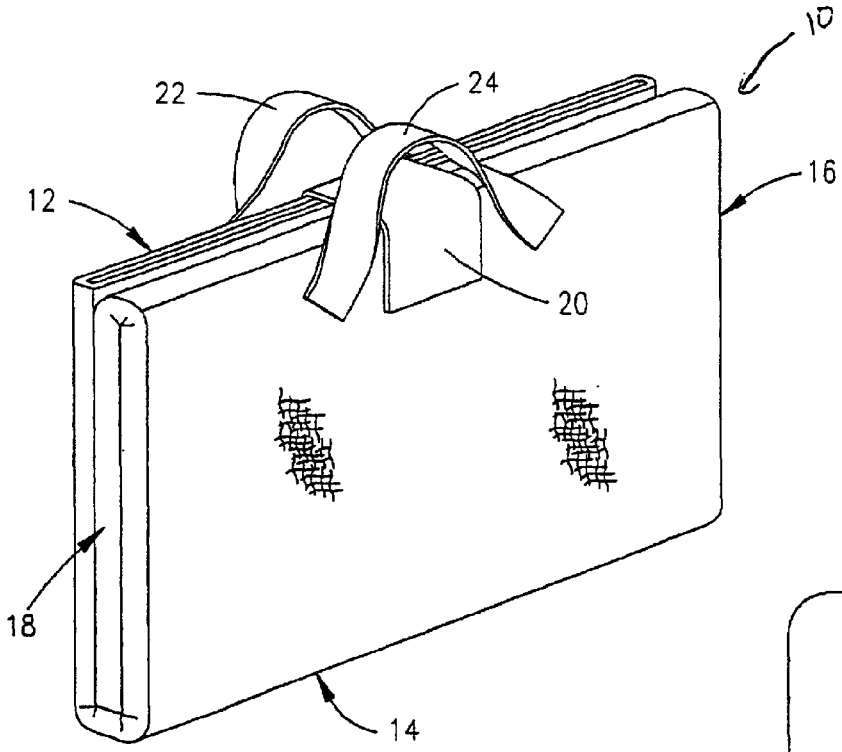
FIG. 1 is a perspective view of a diaper changing pad, or blanket, of the present invention, folded into a carrying bag formation.

With reference initially to FIG. 1, the blanket or changing pad of the present invention is illustrated generally by the reference numeral 10. As illustrated in FIG. 1, the blanket or changing pad 10 is in a folded formation, thus providing a convenient carrying bag or case for articles stored therein. Particularly, blanket or changing pad 10 has a top, generally denoted by reference numeral 12, a bottom, generally denoted by reference numeral 14, and first and second outer sides, denoted generally by reference numerals 16 and 18, respectively. A flap 20, as described in greater detail below, is provided for holding the blanket or changing pad 10 in the folded position illustrated in FIG. 1. A pair of handles 22, 24, are provided at opposite sides proximate the top 12 of the blanket or changing pad 10 in its folded configuration. Particularly, handle 22 is located at one major side of the folded blanket or changing pad 10, while handle 24 is positioned at an opposite major side thereof.

Figure 3:
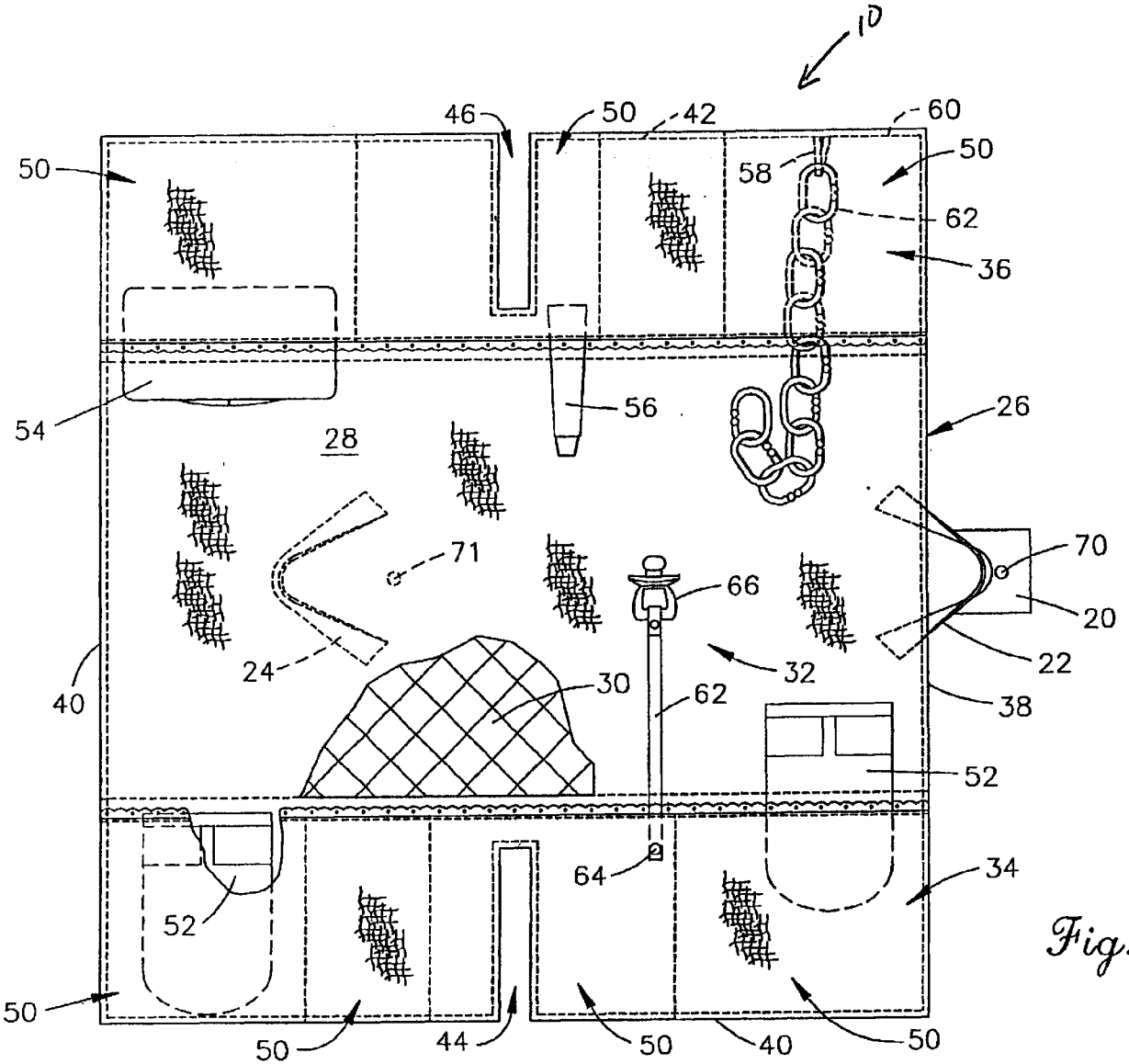
FIG. 3 is a top plan view of the blanket or changing pad of the present invention, unfolded for use.

With additional reference to FIG. 3, blanket or changing pad 10 of the present invention is formed of any conventional fabric. Particularly, blanket or changing pad 10 is formed of a generally rectangular panel of material, denoted generally by reference numeral 26. Preferably, panel 26 of changing pad or blanket 10 is formed of first and second outer layers consisting of a top layer 28, and a bottom layer (not shown). The top layer 28 and bottom layer (not shown) panel 26 separate a third, inner layer, denoted generally by reference numeral 30. The inner layer is preferably a stiffener or padding. The layers are sewn together as illustrated by stitch 60.

As illustrated in FIG. 3, blanket or changing pad 10, when unfolded, has a central major diaper changing surface, denoted generally by reference numeral 32. Panel 26 also has first and second outer side portions 34, 36, respectively. As illustrated, panel 26 of blanket or pad 10 has a top edge 38, a bottom edge 40, and first and second outer side edges 40, 42, respectively. Each side portion 34, 36 has a respective slot 44, 46 therein extending inwardly from a respective outer edge 40, 42 of panel 26. As described in greater detail below, each slot 44, 46 receives a portion of a safety strap on a conventional changing table.

As illustrated in FIG. 3, each outer side portion 34, 36 has a plurality of pockets 50. Pockets 50 are preferably of various sizes, and are adapted to receive items for storage. As illustrated, the pockets 50 are preferably sized for receiving items such as diapers 52, wipes in a container 54, and lotions or creams, such as indicated by tube 56. Optionally, one or all of the pockets may have a closure, such as a hook and loop fastener, snap, button, or zipper, for closing the pockets.

In accordance with an aspect of the invention, an elastic loop 58 is provided on blanket or pad 10. It will be appreciated that any desired number of loops may be provided on blanket or pad 10. Preferably, loop 58 is sewn into one of the pockets 50 of blanket or pad 10, by stitching 60. The loop 58 is adapted to releasably receive a toy, such as a link, or linkage chain 62, as illustrated. Additionally, a flexible strap 62 is sewn, or secured by a fastener 64, to blanket or pad 10. The flexible strap 62 is adapted to releasably hold a toy or pacifier, such as the pacifier 66 illustrated. As will be appreciated, the linkage chain 62 and pacifier 66 may be utilized to occupy the child when his or her diaper is being changed.

As illustrated in FIG. 3, first handle 22 is positioned on blanket or pad 10 so as to extend beyond top edge 38 thereof. Second handle 24 is positioned on the bottom surface panel 26 in the position shown. Particularly, second panel 24 is preferably positioned approximately one-third the distance from lower edge 40 of panel 26. Thusly oriented, the handles 22, 24 result in the position illustrated in FIG. 1 when blanket or pad 10 is folded into a carrying bag formation. As also illustrated in FIG. 3, flap 20 extends beyond upper edge 38 of panel 26, and has a fastener 70, such as a hook and loop fastener, snap, or button, for holding the blanket or changing pad 10 in the folded formation illustrated in FIG. 1. Particularly, where fastener 70 is a hook and loop fastener, it mates with a fastener pad 71 located on the bottom surface of panel 26, as illustrated, and as will be readily understood.

Figure 2:
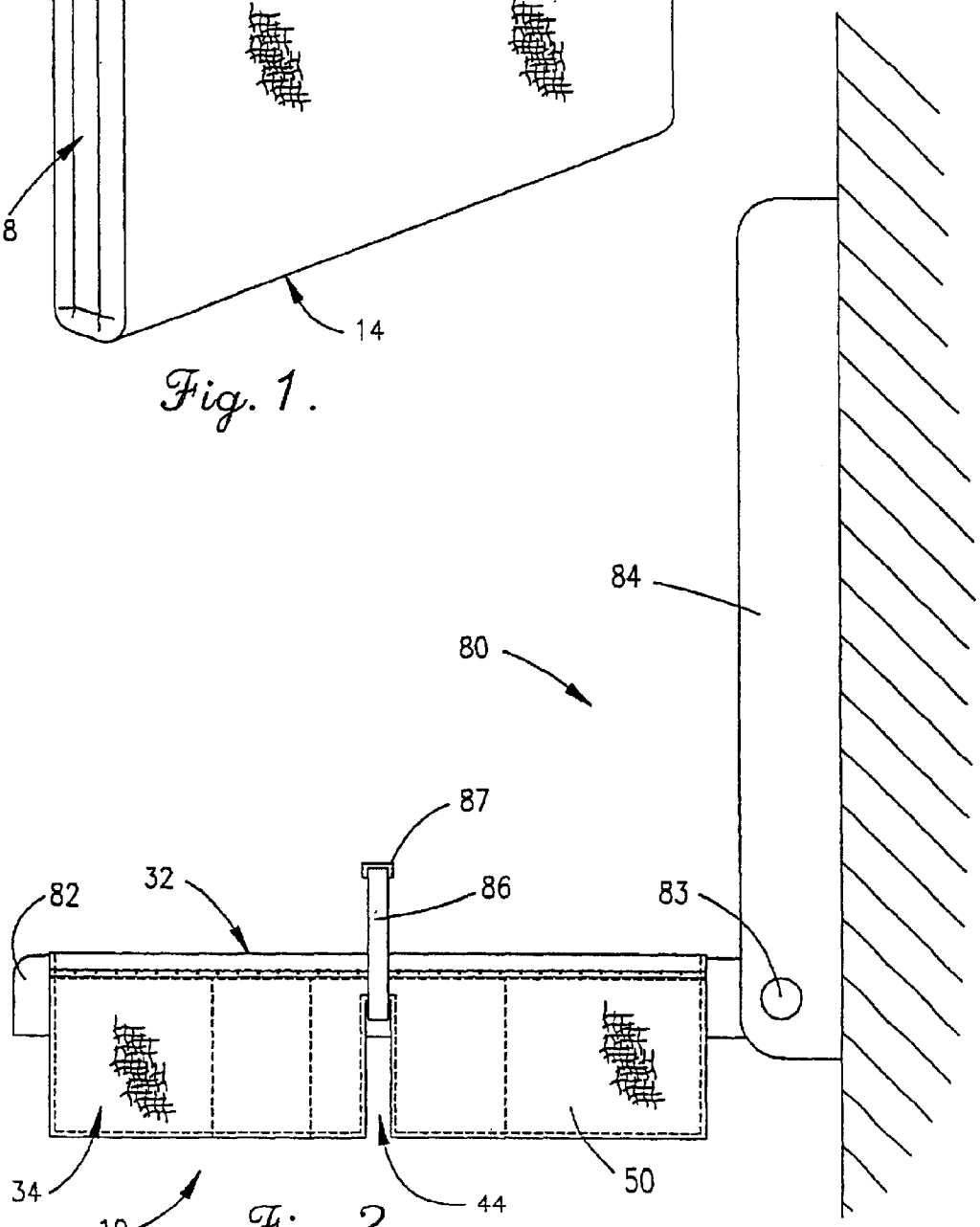
FIG. 2 is an elevational view illustrating the blanket or diaper changing pad of the present invention in position on a changing table having a safety strap.

With reference to FIG. 2, changing pad or blanket 10 is la illustrated on a conventional changing station, denoted generally by reference numeral 80. It will be understood and appreciated that a variety of different types of changing tables are known, and may be utilized in combination with the present invention. Particularly, as illustrated, changing station 80 has a changing table 82 which pivots downwardly, about a pivot location 83, from a wall mount 84. The changing station has a safety strap 86, as illustrated. As will be readily understood and appreciated, safety strap 86 has a corresponding component (not shown) positioned at an opposite side of changing table 82. The safety strap is positioned over a child lying on the, changing table 82, and buckled or fastened in place by fastener 87.

As illustrated, changing pad or blanket 10 of the present invention is positioned over changing table 82. Particularly, the major, central changing portion 32 of panel 26 of changing pad or blanket 10 is positioned on an upper surface of table 82. Changing pad or blanket 10 is dimensional so that side portions 34 and 36 depend downwardly from respective sides of table 82. In this manner, the pockets 50, containing those items needed to change the child's diaper, are readily accessible without the need to leave the child unattended while reaching in a separate diaper bag. Additionally, as illustrated, slots 44 receive safety strap 86, thus preventing the changing pad or blanket 10 from bunching, or being bundled, on table 82. In such a position, the pacifier 66, or linkage chain 62, is readily available (while remaining attached to the pad 10) for the child to enjoy while his or her diaper is being changed.

It will be understood and appreciated that the dimensions of blanket or pad 10 can be any dimensions selected by the fabricator of the article. Preferably, however, the central changing portion of pad 10 is at least wide enough to permit side portions 34, 36 to hang vertically downward when pad 10 is positioned on a conventional changing table. In this regard, one preferred dimension for the central changing portion 32, between the side portions, is approximately 17 inches.

In order to fold the blanket or pad 10 from its unfolded position of FIG. 3, or its position on a changing table as illustrated in FIG. 2, the side portions 34, 36 are folded inwardly over the upper surface of central changing portion 32. In accordance with the preferred dimensions of the invention, the first folding operations result in the side portions 34, 36 being slightly overlapped. Next, the pad or blanket 10, having side portions 34, 36 inwardly folded, is folded approximately in thirds in a fold direction transverse to the folds of the side portions 34, 36. Particularly, a portion of the pad 10 from the lower edge 40 of pad 10 to approximately the second handle 24 is folded upwardly over the upper surface of central changing portion 32. The folded over third and the approximately one-third portion of pad 10 that it covers are then together folded over the remaining third of pad 10, to the configuration illustrated in FIG. 1. In such a folded configuration, handles 22, 24 meet at the top 12 of pad 10, thereby forming a carrying bag or case. Flap 20, fixedly secured at one side of pad 10, is passed through the loops formed by handles 22, 24 and releasably secured by the fastener 70, 71 to the opposite side of the folded pad, thereby holding pad 10 in its folded configuration.

The blanket or pad 10 provides a unique cloth article which is convertible to a carrying bag, as illustrated and described. The pad 10 conveniently stores articles for carrying and further conveniently places the articles in proximity to a user, and within a preferred line of sight, when pad 10 is used on conventional changing tables. Pad 10 is also washable.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A device for providing a surface for changing a diaper of a baby or child, said device comprising:

a foldable and unfoldable, flexible panel of material having a top side and a bottom side, said panel of material forming a central surface on said top side, and first and second side portions located respective opposite sides of said central surface and are each approximately one half the size of said central surface;

at least one of said side portions having at least one pocket positioned on said top side of said panel of material;

a first handle extending from an outer side edge of said panel of material;

a second handle located on said bottom side of said panel of material at a location approximately one-third the distance from a side edge of said panel opposite said side edge from which said first handle extends; and wherein said device forms a carrying case when said first and second side portions are folded inwardly over said top side of said panel of material so that first and second portions are slightly overlapped, and said folded panel of material is further folded, approximately in thirds, in a direction opposite the fold of said side portions, resulting in said first and second handles being adjacent each other.

2. The device as set forth in claim 1, further including a flap, extending outwardly from said side edge from which said first handle extends, for releasably engaging with said bottom surface of said panel of material, when folded into said carrying case, for holding said carrying case together.

3. The device as set forth in claim 1 wherein each of said side portion has a plurality of pockets, and wherein at least one of said pockets has a loop secured therein.

4. The device as set forth in claim 3, further comprising means for releasably securing a pacifier thereto.

5. The device as set forth in claim 1, wherein said panel of material comprises first and second outer layers, and an inner layer positioned between said first and second outer layers.

6. The device as set forth in claim 5, wherein said inner layer is a stiffener.

7. A device comprising:

a blanket having a top surface and a bottom surface, an upper edge, a lower edge, and first and second outer side edges, said blanket including a center portion and first and second outer side portions, whereby said first and second outer side portions are approximately one half the said of said center portion;

at least one handle on said blanket, wherein said blanket is foldable and unfoldable, and wherein said blanket forms a carrying bag having a top and a bottom when said first and second outer side portions of said blanket, including said first and second outer side edges, respectively, are first folded inwardly over said center portion so that first and second outer side portions are slightly overlapped and, said blanket thusly folded, is further folded in approximately thirds in a direction transverse to said first fold, such that said at least one handle extends from said top of said carrying bag.

8. The device set forth in claim 7, further comprising a fastener for releasably fastening said blanket in said folded, carrying bag formation.

9. A device for providing a surface for changing a diaper of a baby or child, said device comprising:

a foldable and unfoldable, flexible panel of material having a top side and a bottom side, said panel of material forming a central surface on said top side, and first and second side portions located respective opposite sides of said central surface;

at least one of said side portions having at least one pocket positioned on said top side of said panel of material;

a first handle extending from an outer side edge of said panel of material;

a second handle located on said bottom side of said panel of material at a location approximately one-third the distance from a side edge of said panel opposite said side edge from which said first handle extends;

a flap, extending outwardly from said side edge from which said first handle extends; and wherein said device forms a carrying case when said first and second side portions are folded inwardly over said top side of said panel of material, and said folded panel of material is further folded, approximately in thirds, in a direction opposite the fold of said side portions, resulting in said first and second handles being adjacent each other, and wherein said flap being used for releasably engaging with said bottom surface of said panel of material, when folded into said carrying case, for holding said carrying case together.

10. A device for providing a surface for changing a diaper of a baby or child, said device comprising:

a foldable and unfoldable, flexible panel of material having a top side and a bottom side, said panel of material forming a central surface on said top side, and first and second side portions located respective opposite sides of said central surface;

at least one of said side portions having at least one pocket positioned on said top side of said panel of material, wherein each of said side portion has a plurality of pockets, and wherein at least one of said pockets has a loop secured therein;

a first handle extending from an outer side edge of said panel of material;

a second handle located on said bottom side of said panel of material at a location approximately one-third the distance from a side edge of said panel opposite said side edge from which said first handle extends; and wherein said device forms a carrying case when said first and second side portions are folded inwardly over said top side of said panel of material, and said folded panel of material is further folded, approximately in thirds, in a direction opposite the fold of said side portions, resulting in said first and second handles being adjacent each other.

11. The device as set forth in claim 10, further comprising means for releasably securing a pacifier thereto.

* * * * *